United States Patent [19]

Finch

[11] 3,955,221

[45] May 11, 1976

[54] ELEVATED SAFETY BATHTUB

[76] Inventor: Eve B. Finch, 5190 SW. Chestnut St., Beaverton, Oreg. 97005

[22] Filed: Jan. 3, 1975

[21] Appl. No.: 538,341

Related U.S. Application Data

[63] Continuation of Ser. No. 230,639, March 1, 1972, Pat. No. 3,864,762.

[52] U.S. Cl. ..... 4/173 R; 4/113

[51] Int. Cl.[2] ..... A47K 3/00; A47K 3/14

[58] Field of Search ..... 4/173, 183, 145, 146, 4/173, 174, 175, 177; 128/365, 369

[56] References Cited

UNITED STATES PATENTS

| | | | |
|---|---|---|---|
| 3,066,316 | 12/1962 | Russell | 4/173 |
| 3,113,323 | 12/1963 | Beardsley | 4/173 |
| 3,505,693 | 4/1970 | Corbett | 4/173 |

FOREIGN PATENTS OR APPLICATIONS

| | | | |
|---|---|---|---|
| 459,383 | 8/1935 | United Kingdom | 4/183 |

*Primary Examiner*—Richard E. Aegerter
*Assistant Examiner*—Larry Jones
*Attorney, Agent, or Firm*—Chernoff & Vilhauer

[57] ABSTRACT

An elevated safety bathtub for use both by invalids and by persons without physical handicaps. The tub has a floor supported approximately at normal chair height and a side opening serving as an entryway through one of the walls of the tub, the bottom of the entryway being substantially at the same elevation as the floor of the tub. The entryway is provided with a water-tight barrier which may be moved out of the way to permit a person to enter the tub, and replaced once the person is inside the tub. The fact that the bottom of the entryway and floor of the tub are supported at approximately chair height enables the person to enter the tub by simply seating himself on the floor of the tub through the entryway as if he were seating himself in a chair. The person need not stand on the slippery tub floor. Several embodiments of the invention comprise adapter assemblies for converting existing conventional bathtubs to elevated bathtubs having the features of the present invention. These latter embodiments provide a tub shell for mounting on top of the existing tub so that the floor of the tub shell is approximately at chair height. Means are provided for securing the tub shell to the existing tub to prevent any horizontal slippage between the two, and provision is also made for adapting the existing plumbing for use with the elevated tub shell.

10 Claims, 10 Drawing Figures

ELEVATED SAFETY BATHTUB

This application is a continuation of copending application Ser. No. 230,639, filed Mar. 1, 1972, now U.S. Pat. No. 3,864,762.

BACKGROUND OF THE INVENTION

This invention relates to a bathtub having features which insure the safe and convenient ingress and egress of a person into and out of the tub, whether the person be an invalid or one having no physical handicaps whatsoever.

In invalid or safety bathtubs known to the prior art, as shown for example in Fowler U.S. Pat. No. 2,570,053, a bathtub is provided with a water-tight side door for purposes of easier ingress and egress from the tub. The problem with the Fowler tub, and with other tubs employing a side door, is that a person must stand on the slippery floor of the tub while entering or leaving. In addition, once having entered the tub, he must crouch down and then slide his legs forward in order to assume a normal bathing position, i.e., seated with legs extended on the tub floor. Since numerous deaths and injuries are caused by slipping while entering and exiting a bathtub in a standing position, the Fowler tub and those similar to it fail to eliminate the major personal danger involved in bathing. The dangers are further magnified if the bather is an invalid. Furthermore, the fact that an invalid using the Fowler tub would have to crouch down to assume a normal bathing position, and rise to a standing position in order to leave the tub, hardly offers sufficient convenience for an invalid having limited bending capability in his back or legs.

A second generation of bathtub inventions is illustrated by Hanson U.S. Pat. No. 3,380,078, which provides a seat within the bathtub and an entrance door at the end of the tub opposite the seat. As in the case of the Fowler tub, however, the type of tub depicted by this patent requires the bather to stand on the slippery tub floor while entering and leaving the tub. Moreover, even though a seat is provided in the tub which allows a person to assume a seated position without having to crouch down, this position is not the normal bathing position seated with legs extended on the floor of the tub, and the ability of the person to comfortably soak and wash in the tub in the conventional manner is therefore greatly limited.

In order to solve the above deficiencies of prior art bathtubs, elaborate mechanical means have been employed in order to provide both safety and convenience in the use of bathtubs. For example, in Moran U.S. Pat. No. 3,604,018, a rotatable drum is provided in the tub wall with an open segment to provide an entrance into the bathtub. The bather sits on the seat within the drum and the drum is rotated by a motor until the open segment faces the interior of the bathtub. The seat is then lowered by another motor to the bottom of the tub so that the person can bathe. To get out of the tub, the procedure is reversed. In order to construct and maintain a bathtub of this type, a considerable expenditure of money is necessary because of its complex system of motors and moving parts. For most individuals or families such a tub is probably beyond their economic means.

SUMMARY OF THE PRESENT INVENTION

The present invention is directed to a safety bathtub of the general type described wherein a bathtub is supported at an elevation so that the tub floor is substantially at chair height. One basic embodiment of the invention comprises an original installation tub with integral structure supporting the elevated tub floor, while another embodiment comprises an adapter assembly which can be used to convert a standard, existing floor-supported bathtub into an elevated safety bathtub. The latter embodiment comprises a bathtub shell with means for mounting the shell on the existing bathtub so that the shell floor is supported above the top of the existing bathtub at approximately chair height. All of the embodiments of the invention include a sealable opening or entryway in the tub or shell wall, with its bottom substantially at the same level as the floor of the tub or shell, through which a person may enter or exit conveniently and safely.

The novel constructional features of the safety bathtub of the present invention provide it with several important advantages. First, when the sealable entryway is open, a person entering the bathtub may seat himself on the elevated tub floor through the opening, with his feet resting on the bathroom floor outside and below the tub. He then adjusts his position, all the time sitting on the floor of the tub, until his body is wholly within the tub in normal bathing position, i.e., seated with legs extended on the tub floor. The sealable entryway is then closed and the tub filled with water. After bathing, the process is reversed and the person exits from the tub by adjusting his position, while seated on the tub floor, until his feet are positioned on the bathroom floor or other surface located outside and below the tub. At no time during the ingress or egress procedure is the person forced to stand or walk on the slippery tub floor, nor is he forced to bend his back or legs to an extent greater than that necessary to sit down in a chair.

In addition, the safety bathtub of this invention provides a person, and even more importantly an invalid, with the above safety and convenience advantages without requiring any expensive, mechanically complex structure, such as that set forth in the Moran patent. Rather the present invention, due primarily to the elevation of the complete tub floor, provides a relatively inexpensive, virtually repair-free structure for bathing, with a minimum of movable parts and no requirement for motors or other power devices. As a result, both original installation and maintenance costs will be minimal. The original installation cost can be further reduced by employing the adapter assembly of the invention in conjunction with a presently existing bathtub.

It is therefore a principal object of the present invention to provide a new and improved safety bathtub which allows persons to enter and leave the tub without having to stand or walk on the slippery and dangerous floor of the tub.

It is a further object of the present invention to provide a bathtub which enables a bather to assume a normal bathing position, i.e. seated on the floor of the tub with legs extended, without requiring him to bend his back or legs to an extent greater than that necessary to sit down in a chair.

It is a still further object of the present invention to provide a safety bathtub as described above which can be procured for a reasonable investment and which has a minimum number of movable or powered parts so that maintenance costs are minimized.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
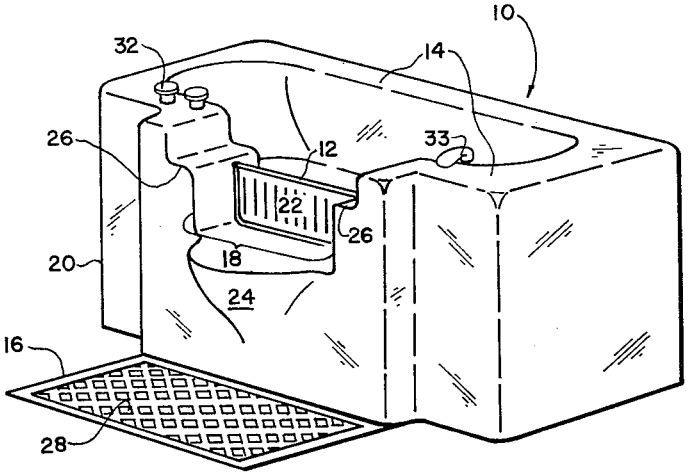
FIG. 1 is a perspective view of one embodiment of the safety bathtub of the present invention.

The safety bathtub, designated generally as 10 in FIG. 1, comprises a bathtub floor 12 with a surrounding wall 14 for holding a quantity of water. Although the preferable configuration for the perimeter of the tub is essentially rectangular, any shape may be employed in the practice of this invention such as a round or oval configuration. The bathtub 10 is adjacent to a surface 16, which may merely comprise a portion of the bathroom floor, and the tub floor 12 is supported by the structure of the bathtub at a distance above the surface 16 approximately equal to normal chair height.

In the wall 14 directly above the surface 16 is an opening 18 extending downwardly from the top of the wall 14 approximately to the level of the bathtub floor 12. The opening 18 is fitted with a movable water-tight barrier 22, to be described hereafter in greater detail, capable of sealingly closing the opening 18 after the person has positioned himself within the tub 10 for bathing. Although any of a large variety of water-tight barriers may be employed, a simple manually operated door or movable screen is preferred for purposes of economy. The wall 14 may optionally include an outwardly projecting seat 24 and arm rests 26 adjacent the opening 18 for the comfort of the bather and to aid him in entering and leaving the tub. Moreover, in order to provide additional safety for the bather, the surface 16 is preferably provided with a skid-resistant covering, comprising for example a rough finished, non-skid synthetic polymer, upon which the person can stand. The surface may consist of a grating 28 with a drain underneath for collecting any water which may leak or overflow from the opening 18.

A person wishing to use the bathtub 10 stands on the surface 16 and opens the water-tight barrier 22. He then turns and, with his back to the opening 18, seats himself upon the tub floor 12 through the opening 18, with his feet resting on the surface 16. He positions himself lengthwise within the tub by lifting his legs, pivoting his body, and swinging his legs over the tub wall so that he is sitting on the tub floor 12 with his legs extended. Thereafter he closes the water-tight barrier 22 and fills the tub with water by means of the hot and cold water controls 32 which are conveniently located at a position near the end of the tub opposite the spigot 33 so that the bather can readily reach them without having to lean forward from his normal bathing position. After bathing, he reverses his movements in order to exit from the tub.

Figure 3:
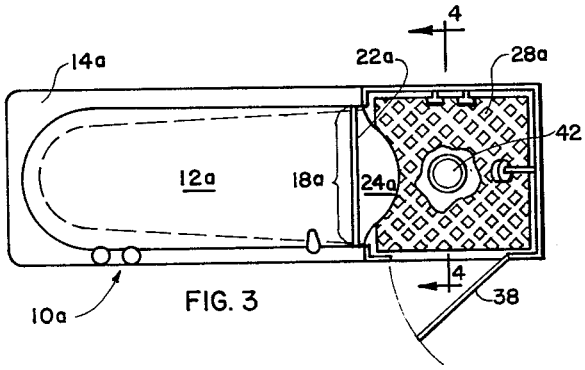
FIG. 3 is a plan view of the embodiment shown in FIG. 2.
Figure 4:
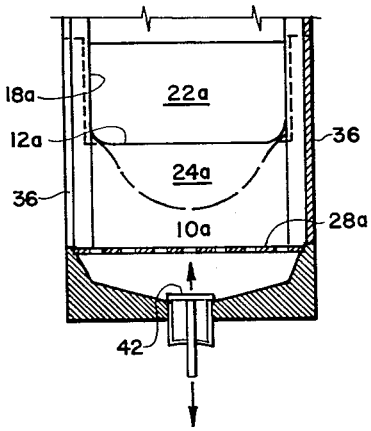
FIG. 4 is a partial cross sectional view taken along line 4—4 of FIG. 3.
Figure 2:
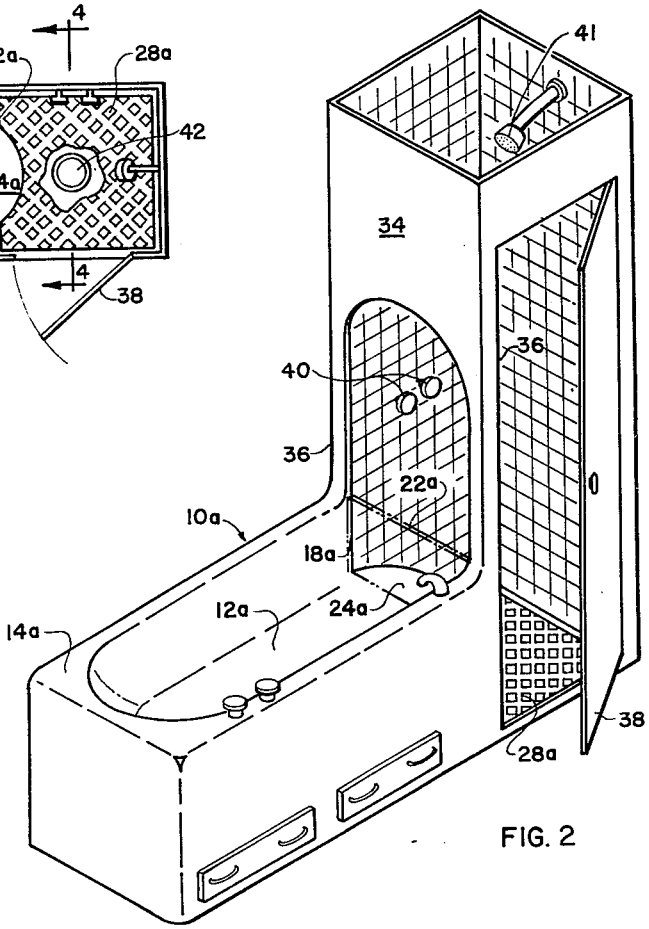
FIG. 2 is a perspective view of a second embodiment of the invention, showing a shower stall coupled with the safety bathtub.

A second embodiment of the invention is shown in FIGS. 2, 3 and 4, which illustrate a safety bathtub **10*a* communicating with a shower stall 34 through an opening 18*a* located in the end, rather than the side, of the tub. A grating 28*a*, covered with a suitable non-skid material, comprises the shower stall floor. The shower wall 36 is connected to the tub wall 14a so that, when the shower stall door 38 is closed, a complete unit is formed comprising both the tub and the shower which allows a person either to bathe or shower within the confines of the single unit. As in FIG. 1, the floor 12*a* of the bathtub portion 10*a* is supported at substantially normal chair height above the grating 28*a*, and the opening 18*a* in the wall 14*a* allows ingress and egress into and out of the tub 10*a* from the shower stall 34. A movable water-tight barrier 22*a* is provided in the opening, and a seat 24*a* may be included extending outwardly from the tub floor 12*a* into the shower stall 34. The hot and cold water controls 40 for the shower stall 34 are placed conveniently near the opening 18*a* and seat 24*a* so that a person taking a shower while seated on the seat or in the opening can regulate the temperature and rate of flow of the water. In addition, the controls 40 are located on a wall other than that containing the shower head 41** so that a person standing in the shower can easily make adjustments while avoiding the spray from the shower head.

Beneath the grating 28a is a conventional, mechanically closable drain 42, best illustrated in FIG. 4. Since the shower door 38 is water-tight, the drain 42 can be closed and water confined within the periphery of the shower walls 36 so that the floor of the shower stall 34 can be used as a foot soaking basin by the bather.

The bathtub **10*a* is sufficiently large to permit a person to assume a normal bathing position within the tub by simply standing in the shower stall with his back to the opening 18*a*, sitting down on the elevated tub floor 12*a*, sliding himself back from the opening until his legs are inside the tub, and closing the water-tight barrier 22*a* behind him. It should be noted that the opening 18*a* and shower stall 34 need not necessarily be located at the end of the tub 10*a*, but could instead be located on the side of the tub, as in FIG. 1**, if space considerations so dictated.

Figure 5:
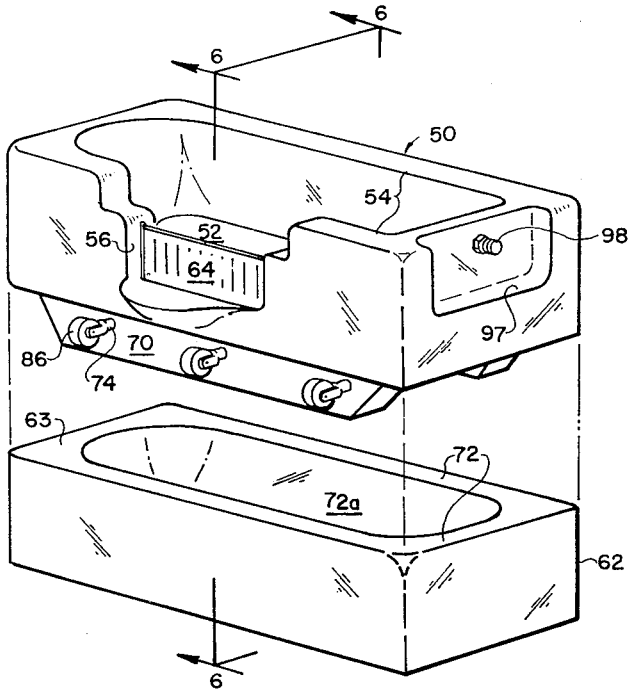
FIG. 5 is an exploded perspective view of a third embodiment of the invention featuring an adapter assembly for existing bathtubs.

The two embodiments of the invention discussed so far are primarily intended for original installation in new homes, or for inclusion in re-designed bathrooms. A third embodiment provides for an adapter assembly to be mounted on top of an existing floor-supported bathtub, the resultant product being a simple, low-cost safety bathtub having the basic advantageous features of the previously described embodiments. Referring to FIG. 5, the adapter assembly comprises a bathtub shell, generally designated as 50, having a shell floor 52 and a surrounding wall 54 for holding a quantity of water.

Although the configuration of the shell 50 will generally be rectangular, any shape shell may be employed to correspond to the shape of the existing bathtub. In its mounted position, the shell 50 is supported by the existing bathtub 62 at an elevation such that the shell floor 52 is substantially no lower than the top 63 of the existing bathtub. Although the height at which the shell floor 52 is supported may vary depending on the height of the existing bathtub 62, it is preferred that this height be approximately equal to chair height.

Figure 6:
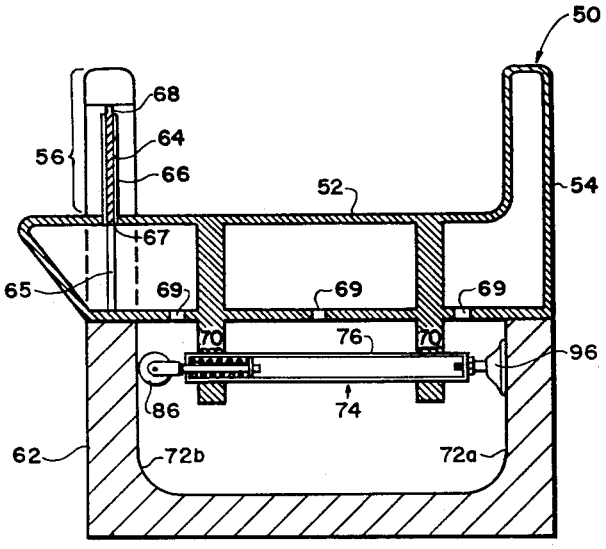
FIG. 6 is a cross-sectional view taken along lines 6—6 of FIG. 5.

As in the embodiment of FIG. 1, an opening 56 in the shell wall 54 extends downwardly from the top of the wall substantially to the level of the shell floor 52, the opening being wide enough to permit a person to seat himself on the shell floor 52 through the opening 56 when the shell 50 is mounted on top of the existing bathtub 62. The opening 56 is fitted with a movable water-tight barrier 64, which preferably comprises a simple, manually operated water-tight door or movable screen. One such type of barrier, which could be employed with any of the embodiments of the invention discussed so far, is illustrated in FIG. 6. The barrier 64 comprises a substantially rigid plastic screen with its sides slidably mounted within a pair of vertical grooves 65 in the shell structure. The portions of the grooves 65 above the shell floor 52 are lined on either side with a gasket material 66 to prevent leakage, as is the slot 67 in the shell floor 52 through which the screen passes. The height of the screen 64 is short enough that it may be manually pushed down into the area below the shell floor 52 until its top is flush with the shell floor. This allows a person to enter the shell 50 in the same manner that he enters the tub 10 of FIG. 1, after which he simply raises the screen 64 into its closed position. A small recessed or retractable handle 68 is preferably provided at the top of the screen 64 to aid the bather in lifting the screen. During bathing the frictional engagement of the screen with the gasket material 66 will probably be sufficient to retain the screen in its elevated position, but if not any conventional type of latching mechanism (not shown) can be used. Any leakage which may pass the gasket material on the inner side of the screen will simply flow into the cavity beneath the shell floor 52 and be drained into the existing bathtub 62 through drain holes 69.

A horizontally reciprocating screen or a hinged door might alternatively be employed in place of the vertically sliding screen 64 of FIG. 6. In the embodiments of FIGS. 1–4, mechanically actuated screens or doors could also be used, but at added expense.

Figure 7:
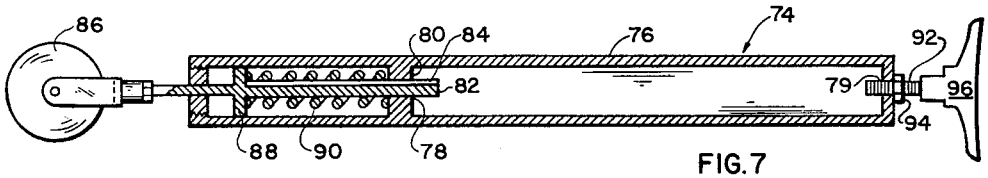
FIG. 7 is an enlarged side sectional view of the coupling device of FIG. 6.

Referring to FIGS. 5 and 6, the bathtub shell 50 is supported on top of the existing tub 62 by the engagement of its downwardly facing bottom surfaces with the top of the walls of the existing tub 62. In addition, a coupling device is attached to the bottom of the bathtub shell 50 for purposes of securing the shell to the existing bathtub. The coupling device comprises two members 70 protruding downwardly from the bathtub shell 50 and positioned so as to fit wholly within the existing bathtub 62. A plurality of adjustable couplers 74 are transversely mounted in the members 70 for engaging the interior of the wall 72 of the existing bathtub 62 so that relative horizontal movement between the shell 50 and the existing bathtub 62 is prevented. As shown more specifically in FIG. 7, the adjustable coupler 74 comprises a tubular housing 76, preferably constructed of aluminum or rigid plastic, having an inner fixed retaining wall 80 with a keyed aperture 78. A movable rod assembly, comprising a rod 82 with a keyed spline 84 to prevent axial rotation of the rod, fits slidably within the keyed aperture 78 of the retaining wall 80. The exterior end of the rod 82 passes slidably through one end of the housing 76 and includes a rubber roller 86 journaled for rotation about a horizontal axis. A disc-shaped shoulder member 88, which fits slidably within the tubular housing 76, is affixed to the rod 82, and separated from the retaining wall 80 by a coil spring 90. The coil spring 90, acting through the shoulder member 88, yieldably urges the roller 86 outwardly from the tube 76 for purposes to be explained hereafter. The opposite end of the tube 76 is provided with a threaded aperture 79, which receives a bolt 92 held tightly in place by a lock nut 94. Affixed to the outer end of the bolt 92 is a suction cup 96.

To install the bathtub shell 50 on top of the existing tub 62, the suction cup 96 of each coupler 74 is adjusted in or out so that it can readily engage the inner surface 72*a* of the existing tub wall 72 (FIG. 6) on the side of the tub which is adjacent the bathroom wall. The shell 50 is positioned on top of the tub 62 and the suction cups 96 are pressed tightly against the inner surface 72*a*, while the side of the shell having the rollers 86 is tipped upwardly. Once the suction cups are engaged, the side of the shell having the rollers 86 is pushed down and, as the rollers engage the inner surface 72*b* of the tub wall 72, the springs 90 allow the respective rollers to yield inwardly, thereby permitting the shell 50 to assume its level mounted position on top of the existing tub 62. The frictional engagement of the suction cups and rollers with the inner surfaces of the existing tub wall 72 prevents the shell 50 from sliding horizontally in any direction, while the vertically positioned rollers 86 permit the shell to be pulled upwardly and removed if desired.

Figure 8:
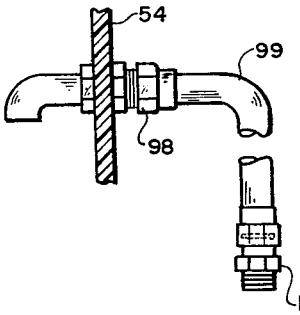
FIG. 8 is an extended detail view of a hose connector assembly employed in the embodiment of FIG. 5.

Any number of systems can be employed to provide plumbing for the tub shell 50. In FIG. 5 a recess 97 is provided in one end of the shell wall 54 positioned to correspond with the locations of the hot and cold water controls of the existing tub 62, thus permitting manual access to the water controls when the shell is in mounted position atop the tub 62. A fitting 98, best illustrated in FIG. 8, communicates through the shell wall and is coupled with a flexible hose 99. The hose 99 includes a quick-disconnect coupling 100 at its opposite end for attaching to the existing tub's spigot. Alternatively, coupling 100 could simply comprise a flexible sleeve for fitting over the spigot, of the type commonly employed in bathtub spray hoses. For drainage, a simple orifice and stopper may be provided in the shell floor 52 to allow bath water to drain into the existing tub 62.

Figure 9:
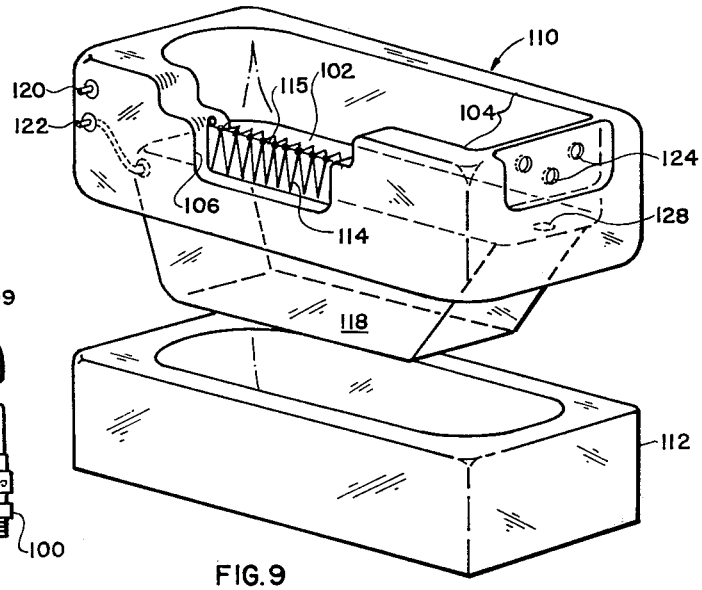
FIG. 9 is an exploded perspective view of a fourth embodiment of the invention showing an inflatable adapter assembly for existing bathtubs.

A fourth embodiment of the invention is an inflatable adapter assembly which can be manufactured at low cost and is useful particularly for traveling. Referring more specifically to FIG. 9, the inflatable adapter assembly comprises a foldable rubber or plastic bathtub shell, designated generally as 110, having a shell floor 102, a surrounding wall 104 with an opening 106, and a water-tight barrier 114. Since all of the components of the shell 110 should be foldable for convenience, the barrier 114 preferably comprises a foldable water-tight curtain sealingly attached at its sides and bottom to the perimeter of the opening 106. The curtain has an excess of material at its top which allows it to be laid flat to allow entry to the tub. The curtain may be secured in a raised position by tightly fastening a cord 115, which passes through the upper folds of the curtain, across the opening 106.

In the embodiment of FIG. 9, an inflatable chamber 118, which fits inside and rests on the bottom of the existing tub 112, provides the principal support for the shell 110, and particularly for the shell floor 102. A pair of air passageways 120 and 122 are provided to inflate the shell wall 104 and the supporting chamber 118 separately. Each of the passageways is provided with a one-way valve fitting so that the passageway into each chamber is closed except when air pressure is applied through the fitting.

A group of flexible, resilient tubular sleeves 124 extend inwardly from apertures located at pistons in the wall 104 corresponding to the locations of the existing tub's water controls and spigot respectively. The sleeves are designed to fit tightly around the controls and spigot so that they may sealingly communicate with the interior of the shell 110 through the wall 104. Alternatively, a hose may be passed from the existing tub spigot over the top of the wall 104, and the water controls manipulated exterior of the shell as in the previous embodiment. The shell floor 102 is provided with an orifice and stopper assembly 128 which allows the inflatable shell 110 to be drained. To avoid interference with the chamber 118, the orifice is located at a point between the interior of the shell wall 104 and the perimeter of the area formed by the attachment of the chamber 118 to the shell floor 102.

Figure 10:
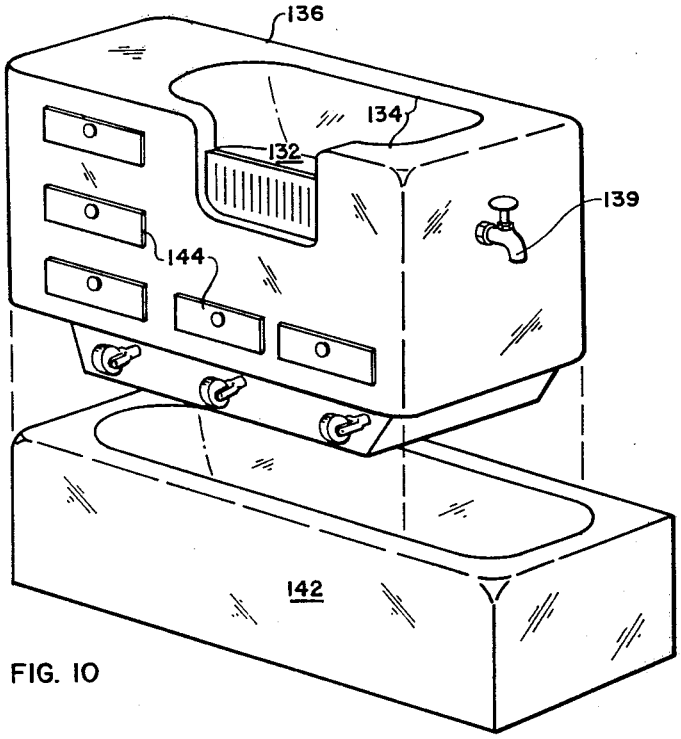
FIG. 10 is an exploded perspective view of a fifth embodiment of the invention showing an infant adapter assembly for existing bathtubs.

A fifth embodiment of the invention is an adapter assembly for bathing infants, as shown in FIG. 10. The adapter assembly is similar in many respects to that of FIG. 5, the principal differences being that the shell floor 132 and inner surrounding walls 134 of the shell 136 are substantially smaller than those provided previously since an infant requires a much smaller bathing area. In addition, the shell 136 is higher and has a shorter longitudinal dimension than the adapter shells previously described, and the height of the shell floor 132 is at counter height (approximately three feet) for convenience in bathing the infant, rather than chair height (approximately 18 inches). An exterior drain spigot 139 communicates with an orifice in the shell floor 132 and drains directly into the excess length of the existing tub 142. The shell 136 is also provided with a plurality of drawers 144 which provide storage for the equipment and supplies needed for bathing the infant.

The terms and expressions which have been employed in the foregoing abstract and specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An apparatus for bathing comprising a. a floor-supported bathtub having a floor and surrounding wall for holding water, a spigot for selectively admitting water into said bathtub and a drain for conducting water from said bathtub; and b. bathtub shell means mounted atop said floor-supported bathtub and having a floor and surrounding wall forming a container for holding water independently of said floor-supported bathtub, said shell being of sufficient dimension to contain a person for bathing and being vertically supported by said surrounding wall of said floor-supported bathtub such that the floor of said shell is at a height substantially no lower than the top of said surrounding wall of said floor supported bathtub, said bathtub shell including support means engaging said surrounding wall of said floor-supported bathtub for detachably mounting said shell atop said floor-supported bathtub and resisting relative horizontal movement between said shell and said bathtub.

2. The apparatus of claim 1 further comprising means for conducting water from said spigot of said floor-supported bathtub into said bathtub shell.

3. The apparatus of claim 1 further comprising drain means in said bathtub shell for conducting water from said bathtub shell to the interior of said floor-supported bathtub.

4. The apparatus of claim 1 wherein the floor of said bathtub shell is substantially no lower than approximately three feet (91.4 cm.) above the floor supporting said floor-supported bathtub when said shell is mounted on top of said floor supported bathtub.

5. The apparatus of claim 1 wherein said bathtub shell is of substantially elongate rectangular configuration having a width dimension approximately equal to that of said floor-supported bathtub and a length dimension shorter than that of said floor-supported bathtub such that a portion of said floor supported bathtub extends beyond said shell.

6. The apparatus of claim 5 further comprising selectively closable drain means in said bathtub shell for conducting water from said bathtub shell into the portion of said floor-supported bathtub extending beyond said shell.

7. The apparatus of claim 1 wherein said bathtub shell is constructed of a substantially rigid material and includes downwardly facing surfaces for engaging the top of said surrounding wall of said floor-supported bathtub to support said shell atop said bathtub.

8. The apparatus of claim 1 wherein said support means includes laterally disposed coupling means for engaging the inner surface of the surrounding wall of said floor-supported bathtub.

9. The apparatus of claim 1 wherein said bathtub shell wall has an opening therein extending from the top of said shell wall downwardly toward said shell floor for permitting a person to seat himself on said shell floor through said opening preparatory to positioning himself wholly within said shell for bathing and water-tight barrier means associated with said opening for sealingly closing said opening after said person has positioned himself wholly within said shell.

10. An apparatus for bathing comprising:

a. a floor-supported bathtub having a floor and surrounding wall for holding water, a spigot for selectively admitting water into said bathtub and a drain for conducting water from said bathtub;

b. bathtub shell means mounted atop said floor-supported bathtub and having a floor and surrounding wall for holding water independently of said floor-supported bathtub, said shell being of sufficient dimension to contain a person for bathing and being vertically supported by said surrounding wall of said floor-supported bathtub such that the floor of said shell is at a height substantially no lower than the top of said surrounding wall of said floor-supported bathtub, said bathtub shell wall having an opening therein extending from the top of said shell wall downwardly toward said shell floor for permitting a person to seat himself on said shell floor through said opening preparatory to positioning himself wholly within said shell for bathing;

c. water-tight barrier means associated with said opening for closing said opening after said person has positioned himself wholly within said shell;

d. sealing means around said opening for sealing said barrier means; and e. drain means adjacent the bottom of said opening, separated from the water-holding interior portion of said shell means by said sealing means, for draining water which may leak through said sealing means into the interior of said floor-supported bathtub.

* * * * *

UNITED STATES PATENT AND TRADEMARK OFFICE

CERTIFICATE OF CORRECTION

PATENT NO. : 3,955,221

DATED : May 11, 1976

INVENTOR(S) : Eve B. Finch

It is certified that error appears in the above-identified patent and that said Letters Patent are hereby corrected as shown below:

| | | |
|---|---|---|
| Col. 3, | Line 15 | Change "cross sectional" to --cross-sectional--. |
| Col. 7, | Line 14 | Change "pistons" to --positions--; |
| | Line 57 | After "comprising" add a colon(:). |
| Col. 8, | Line 3 | Change "floor supported" to --floor-supported--; |
| | Line 21 | Change "floor supported" to --floor-supported--; |
| | Line 27 | Change "floor supported" to --floor-supported--. |

Signed and Sealed this

Fourteenth Day of September 1976

[SEAL]

*Attest:*

RUTH C. MASON
*Attesting Officer*

C. MARSHALL DANN
*Commissioner of Patents and Trademarks*